US006523925B1

(12) United States Patent
Driggers

(10) Patent No.: US 6,523,925 B1
(45) Date of Patent: Feb. 25, 2003

(54) MEDIA LEADING EDGE SENSOR

(75) Inventor: Matt G. Driggers, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/020,069

(22) Filed: Oct. 30, 2001

(51) Int. Cl.[7] ..... B41J 29/38
(52) U.S. Cl. ..... 347/16; 347/19
(58) Field of Search ..... 347/19, 16, 14, 347/23, 12, 10, 105, 104, 106, 101; 399/364; 400/578

(56) References Cited

U.S. PATENT DOCUMENTS 5,605,407 A 2/1997 Hama et al.
5,798,773 A * 8/1998 Hiramatsu et al. ..... 347/19
6,167,231 A 12/2000 Blackman et al.

* cited by examiner

*Primary Examiner*—Lamson Nguyen
*Assistant Examiner*—Charles W. Stewart, Jr.

(57) ABSTRACT

The leading edge of a sheet of print media is detected as the media is advanced through the printer. In response to the detection of the media, a reference signal is generated with the encoder strip that is used to control the position of the carriage assembly. When no media is present in the printer the leading edge detector physically interrupts the drive path that the media follows through the printer. When media is advanced into the detector, the detector is deflected by the advancing media and strikes the encoder strip to generate a reference signal. The printer controller correlates the reference signal with the presence of the media leading edge to begin a counting sequence that correlates the location on the media where printing begins.

20 Claims, 6 Drawing Sheets

MEDIA LEADING EDGE SENSOR

TECHNICAL FIELD

This invention relates to detecting the leading edge of media as it advances through a printer.

BACKGROUND AND SUMMARY OF THE INVENTION

Ink jet printers include various kinds of apparatus for detecting the presence and position of the leading edge of print media, such as a sheet of paper, as the media advances through the printer. Identifying the position of the leading edge of the media is an important step because it is one factor necessary to ensure high quality printing. Thus, when the leading edge of a sheet of paper is advanced past the leading edge detector, a zero point reference signal is typically generated for positioning an image correctly on the media. The zero point reference signal may be an on/off signal that indicates to the printer controller that the leading edge of print media is present, and identifies the position of the leading edge. Through the controller, this reference signal initiates a series of events such as a counting sequence that, among other things, correlates to the position on the media at which ink may begin to be deposited. Since the media is moving through the printer, the counting sequence is one part of the determination of where on the page printing begins.

Ink jet printers include a carriage that may hold one or more ink-filled print cartridges. The carriage reciprocates in a back and forth motion across the printing surface, positioning the ink cartridges adjacent the media for printing. During the printing operation the carriage is shuttled across the paper and ink droplets are ejected out of the cartridge onto the paper in a controlled manner to form a swath of an image each time the carriage is scanned across the page. Between carriage scans, the paper is advanced with a media feed assembly so that the next swath of the image may be printed. Sometimes, more than one swath is printed before the paper is advanced. In some printers, a stationary print head or array of print heads may be provided to extend across the entire width of the paper that moves through the printer.

The relative position of the print head(s) and paper must be precisely maintained to effect high-resolution, high-quality printing. Paper advancement past the print head, and carriage drive functions are typically separately controlled. As to the former, the paper advancement assembly typically includes friction rollers or tractor feed mechanisms that advance the recording media past a "print zone." With an ink jet printer, in the course of advancing the print media between swaths, a disk encoder and associated servo systems are one of the usual methods typically employed for controlling the precise incremental advance of the media. This incremental advance is commonly called "linefeed." Precise control of the amount of the advance, the linefeed distance, is critical for high print quality.

Likewise, the position of the carriage as it reciprocates in a direction transverse to the direction that the paper is fed through the printer must be precisely controlled. Typically, the carriage assembly includes an optical sensor or encoder carried on the carriage such that it is positioned adjacent to - - - typically encircling - - - an encoder strip that extends laterally across the printer. A servo system is used in concert with the encoder and encoder strip to precisely control the position of the carriage relative to the media - - - typically by moving the carriage along a carriage shaft with a continuous drive belt.

The printer controller controls and synchronizes both the reciprocating movement of the carriage, and the linefeed so that ink is deposited in a desired manner on the media.

Detection of the leading edge of media as it advances through the printer is an important component of the printing process because the printer controller relies upon the signal generated by the leading edge to determine the position on the page where printing may begin. For this reason, it is important that the printer controller is informed of the presence and position of the leading edge of the print media so that as the media is advanced past the carriage, ink in the first swath is deposited at precisely the correct location on the page. Many printers utilize separate detectors to perform this so-called "leading edge" or "top of form" sensing. These detectors often are relatively expensive units such as optical sensors or through-beam type sensors that are dedicated to the job of sensing the present of the media leading edge and transmitting a reference signal to the printer controller. In the case of optical sensors, when an optical beam is interrupted by the leading edge of the paper or the media activates a mechanical "flag", the reference signal is generated and transmitted to the controller.

Electro-optical sensors like those described are typically relatively sophisticated and complicated parts that require the use of dedicated hardware such as wiring and cabling, and dedicated input/output on the ASIC controlling the printer. In addition to relative complexity, such sensors can be relatively expensive. Although conventional top of form sensors like those just described function adequately to inform the printer controller of the presence of the media leading edge, given their relative complexity and cost, they also present an opportunity for simplifying printer structure and reducing printer costs by replacing those sensors with simplified apparatus for detecting the leading edge of media advancing through the printer.

The present invention is generally directed to techniques for top of form sensing - - - that is, detecting the leading edge of media as it is advanced through a printer. Rather than relying upon hardware dedicated to the single function of detecting the media leading edge to generate the zero reference point signal, the invention relies upon hardware that is already present in the printer but used for other purposes. In doing so, the top of form sensor of the present invention eliminates costly hardware dedicated to the single function of top of form sensing and simplifies printer structure and operation.

In one approach to the invention, the carriage axis encoder strip that is already incorporated into the printer in connection with the print cartridge carriage is utilized to generate the zero point reference signal upon detection of the media leading edge.

In one embodiment, a mechanical sensor mechanism detects the media leading edge and causes a corresponding signal change in the carriage axis encoder. The controller interprets the signal change to correspond to the presence of the media leading edge. The invention thus relies upon the functionality of existing printer parts to accomplish a task that previously required additional hardware. By relying upon existing parts the costs associated with separate leading edge sensors may be eliminated, thereby simplifying printer construction and operation, and reducing the overall cost of the printer.

In one embodiment, the sensor mechanism comprises a lever that interrupts the media path when no media is present in the printer. When media is advanced through the printer along the media path, the leading edge of the media is advanced into contact with the lever. As the leading edge of the media is advanced into contact with the lever, the lever operates a hammer that contacts the encoder strip. Movement of the encoder strip caused by the touch of the hammer generates a reference signal that is transmitted to the controller corresponding to the presence of the media leading edge.

Apparatus and methods for carrying out the invention are described below. Other advantages and features of the present invention will become clear upon review of the following portions of this specification and the drawings.

DETAILED DESCRIPTION OF PREFERRED EMBODIMENTS

Figure 1:
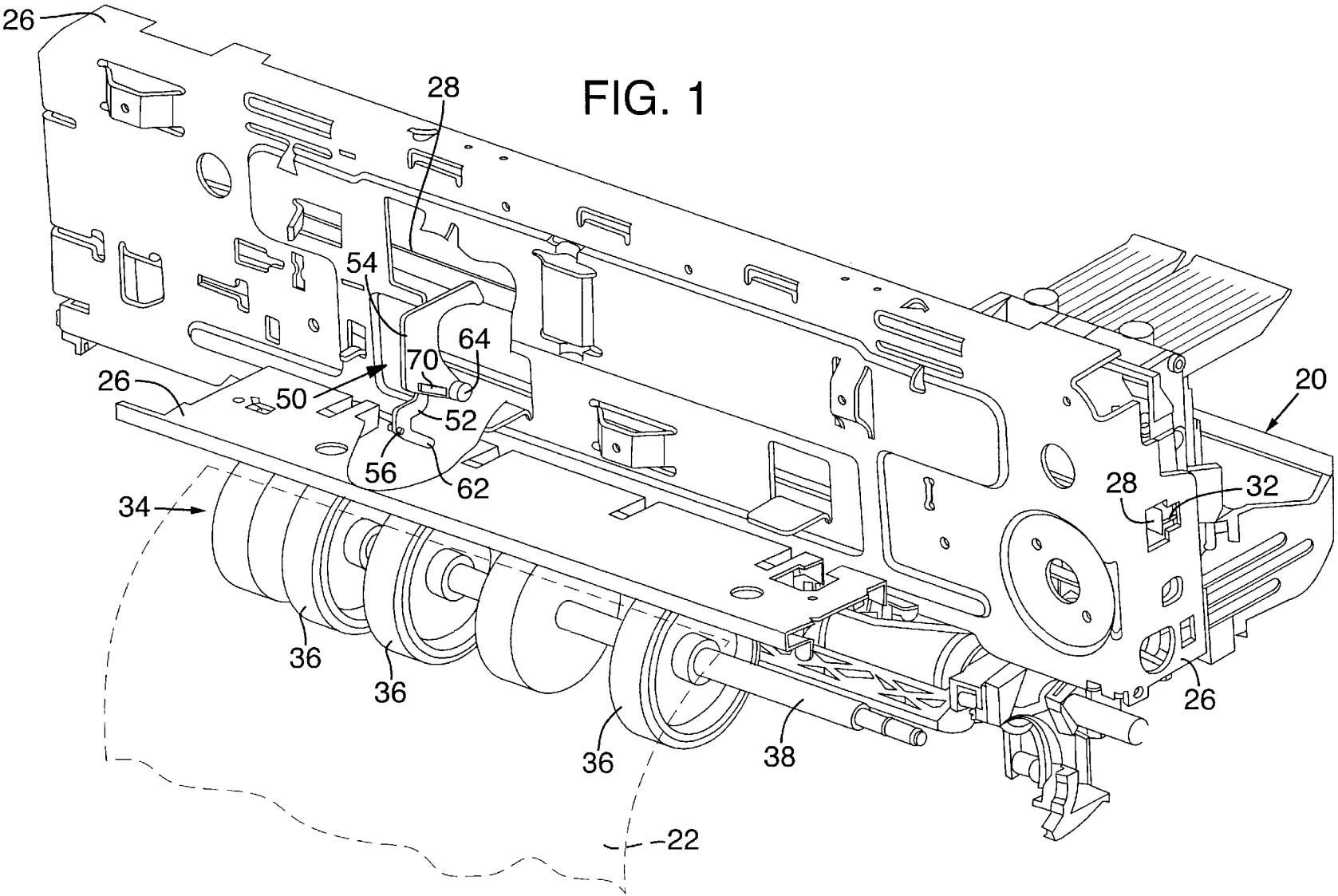
FIG. 1 is a semi-diagrammatic and fragmentary rear perspective view of selected portions of an ink jet printer embodying a top of form sensing mechanism according to the present invention, and having a portion of the printer chassis assembly cut away to illustrate the sensing mechanism.

The semi-diagrammatic illustration of FIG. 1 shows pertinent portions of a representative ink jet printer in which a top of form sensor according to the present invention may be used. For purposes of clarity and to illustrate the invention more clearly, many features of the printer structure are omitted from the Figures. Although the invention is illustrated with respect to its embodiment in one specific type of printer, the invention may be embodied in numerous different types of printers.

Figure 2:
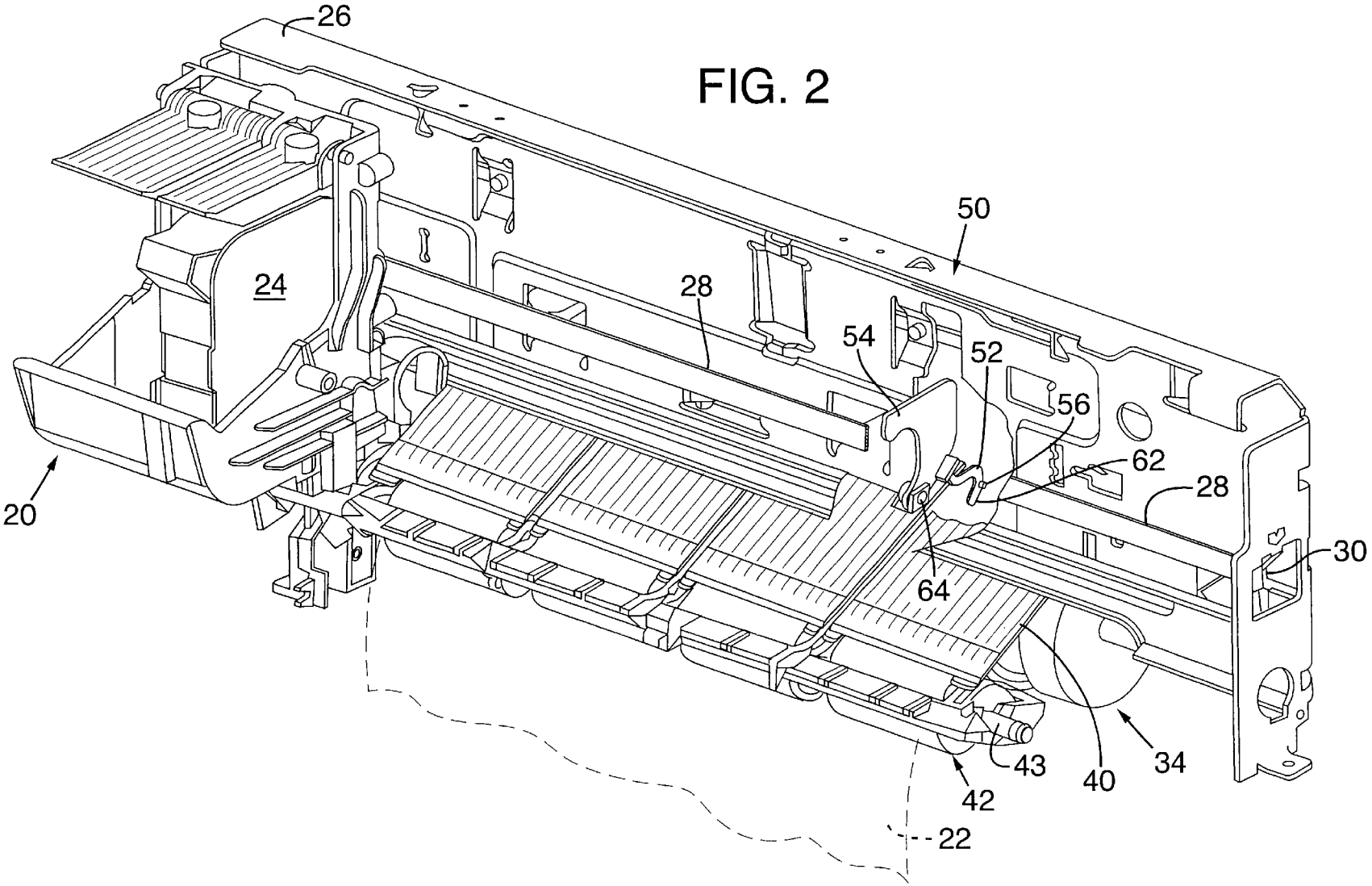
FIG. 2 is a diagrammatic and fragmentary front perspective view of the selected portions of the ink jet printer shown in FIG. 1.

Referring to FIGS. 1 and 2, an ink jet carriage assembly 20 is mounted for shuttle-type reciprocating movement on a shaft (not shown) past print media 22, which is shown in dashed lines in FIGS. 1 and 2. For illustrative purposes, carriage assembly 20 is shown with only one ink cartridge 24, although there are slots for two cartridges in the carriage assembly. Carriage assembly 20 is mounted by conventional means on a printer chassis 26. The particular chassis 26 shown in the figures is used for illustration only, and is exemplary of the many different types of chassis assemblies that are used in printers of the type with which the present invention may be used. The chassis would of course be mounted in a printer housing and numerous other parts would be included in the complete printer.

The carriage assembly 20 supports the cartridge 24 above print media, such as sheet of paper 22. A conventional print head (not shown) is attached to the underside of the cartridge. The print head is a planar member and has an array of nozzles through which the ink droplets are ejected. The cartridge 24 is supported so that the print head is precisely maintained at a desired spacing from the paper 22. The paper 22 is advanced through the printer, and the position of cartridge 24 is controlled to expel ink droplets onto the paper in a desired manner.

Positioned below chassis 26 is a pick wheel assembly 34 that includes plural pick wheels 36 mounted to a rotatable shaft 38. The pick wheels are conventional friction rollers that assist in advancing print media 22 from, for example, a paper tray (not shown) through the printer and past the print heads on cartridges 24. Pick wheels 36 drive the paper through the printer, and rotation of the wheels controls the linefeed. A servo motor controls rotation of shaft 38 and shaft 43, which mounts a forward media feed wheel 42, typically in combination with an encoder disk for precise linefeed control over the advancement of the media. The media may be advanced through the printer with other conventional drive mechanisms such as tractor feed mechanisms.

During printing, carriage assembly 20 is moved back and forth in a direction transverse to the media drive path, which is defined by the path that print media 22 follows as it is advanced around and over the pick wheels, past the print cartridges and out of the printer. Thus, print media 22 as illustrated in, for example, FIG. 5, defines the media drive path. The media drive path axis is defined by the direction that the media moves through the printer.

Figure 9:
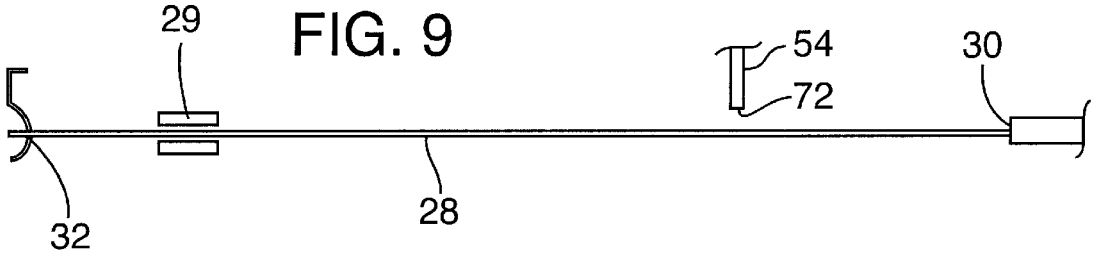
FIG. 9 is a schematic top view of the encoder strip in a neutral position with the carriage parked and the hammer waiting for media to advance through the printer.

Carriage assembly 20 is driven in a conventional manner with a servo motor and drive belt, neither of which are shown. Like shaft 38 and shaft 43, carriage assembly 20 is under the control of the printer controller. The position of carriage assembly 20 relative to print media 22 is determined by way of an encoder strip 28 that is mounted to chassis 26 with one end 30 connected to the chassis and the opposite end connected to the chassis with an encoder strip tensioning spring 32 that maintains tension on the strip yet allows for limited movement of strip. Encoder strip 28 extends past and in close proximity to an encoder or optical sensor 29 (FIG. 9) carried on carriage assembly 20 to thereby signal to the printer controller the position of the carriage assembly relative to the encoder strip. In most instances, the optical encoder 29 carried on the carriage assembly encircles the encoder strip.

Figure 5:
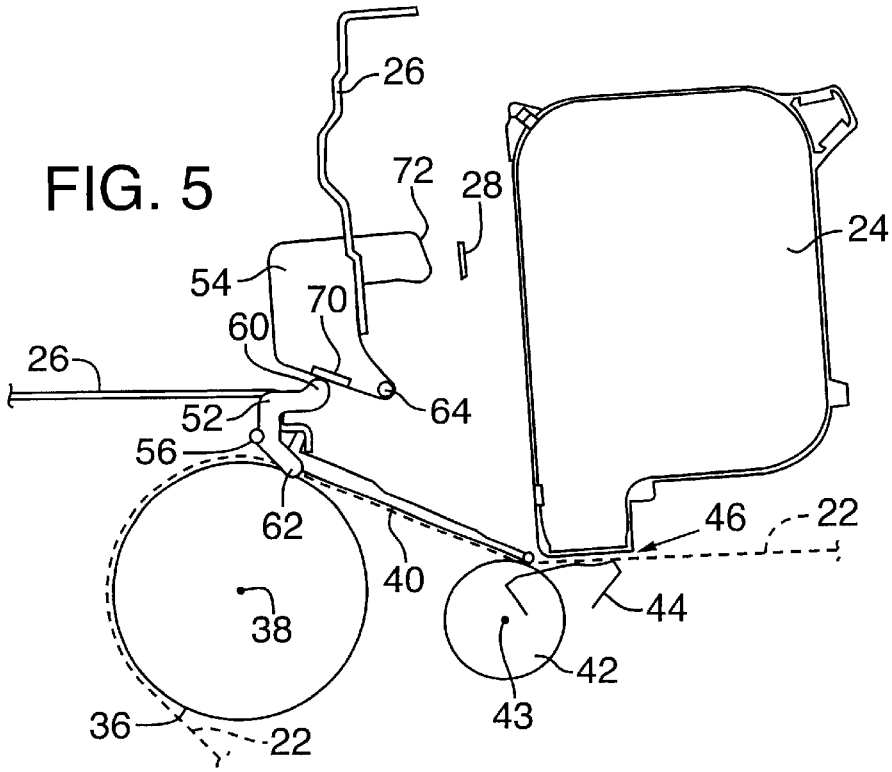
FIG. 5 is a schematic cross sectional side view of an ink jet printer embodying the top of form sensor according to the present invention and illustrating the sensor assembly in a neutral position where no media is present.
Figure 7:
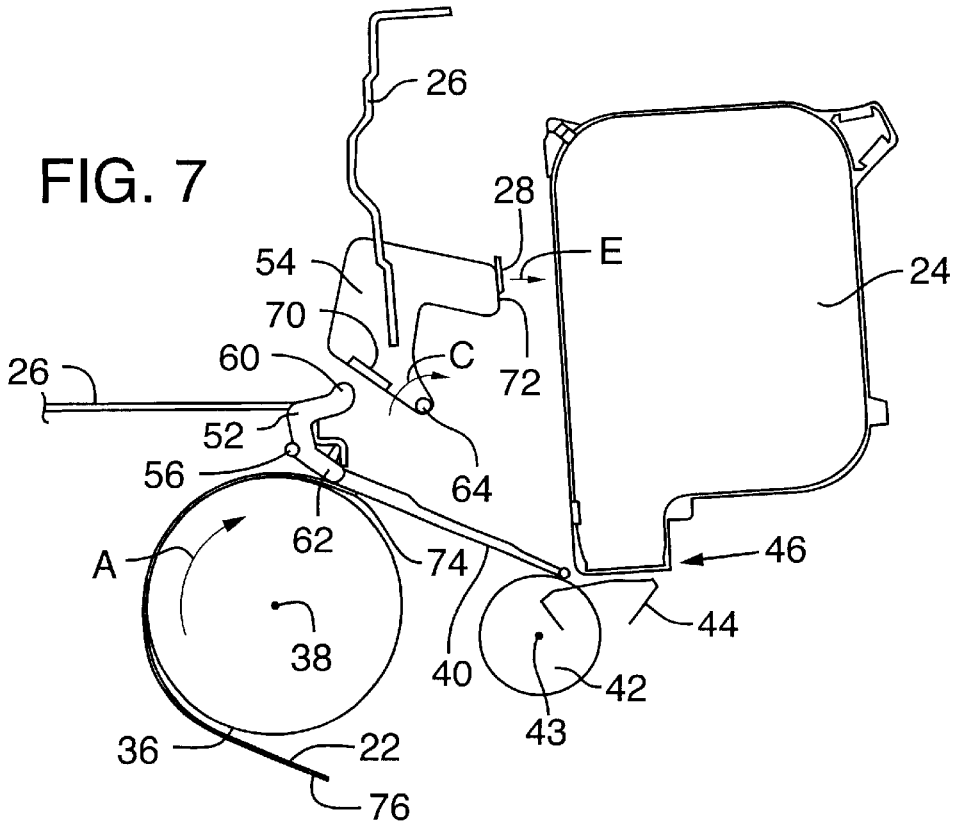
FIG. 7 is a schematic cross sectional view as in FIG. 5 showing the media advancing past the top of form sensing mechanism and the hammer striking the carriage axis encoder strip.

As noted previously, the media drive path is defined as the path that the media follows as it advances through the printer. With reference to FIGS. 1 and 2, the media drive path is the advancement path that media 22 follows over pick wheels 36 and below paper guide 40. Referring now to FIGS. 5 and 7 the complete media drive path may be seen by media 22 as it moves through the printer. Thus, the media drive path follows the outer peripheral surface of pick wheels 36, extends from the pick wheels in the forward direction in the printer and below paper guide 40, over forward feed wheel 42 and over platen 44 where the media is in the "print zone" 46 defined as the space between cartridge 24 and the platen.

Figure 3:
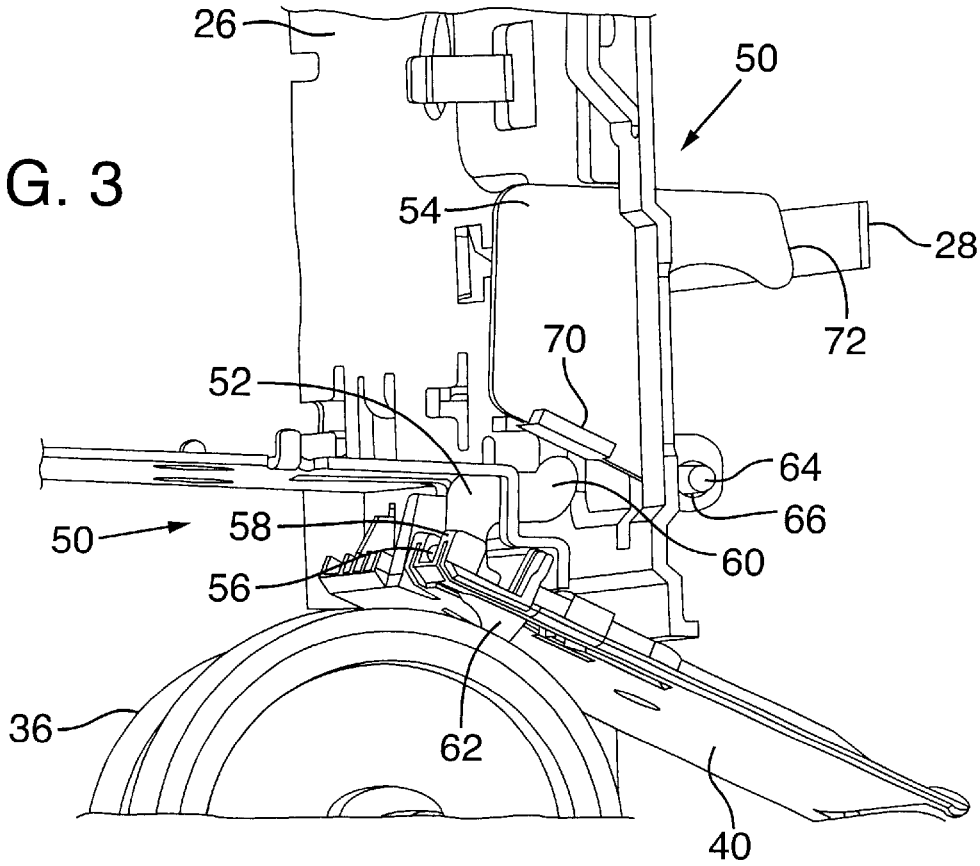
FIG. 3 is a cross sectional and perspective view illustrating the top of form sensing mechanism according to the present invention.

The media leading edge sensor assembly according to the present invention is labeled generally with reference number 50 in FIGS. 1 and 2. As detailed in FIG. 3, assembly 50 includes a lever 52 and an adjacent hammer 54, both of which are mounted for pivotal rotation about an axis that is generally transverse to the media drive path axis. Specifically, an arm 56 extends laterally from each side of lever 52 to define the pivotal axis of the lever. Each arm 56 is mounted to a cooperatively formed slot 58 in paper guide 40 to permit the lever to pivot freely about its rotational axis.

The upper end of lever 52 defines a striker 60, and as detailed below, when lever 52 is in a resting position a tab 62 on the opposite or lower end of the lever extends toward shaft 38, beyond the outer peripheral edge of pick wheels 36 such that tab 62 interrupts the media drive path over the pick wheel assembly.

Figure 4:
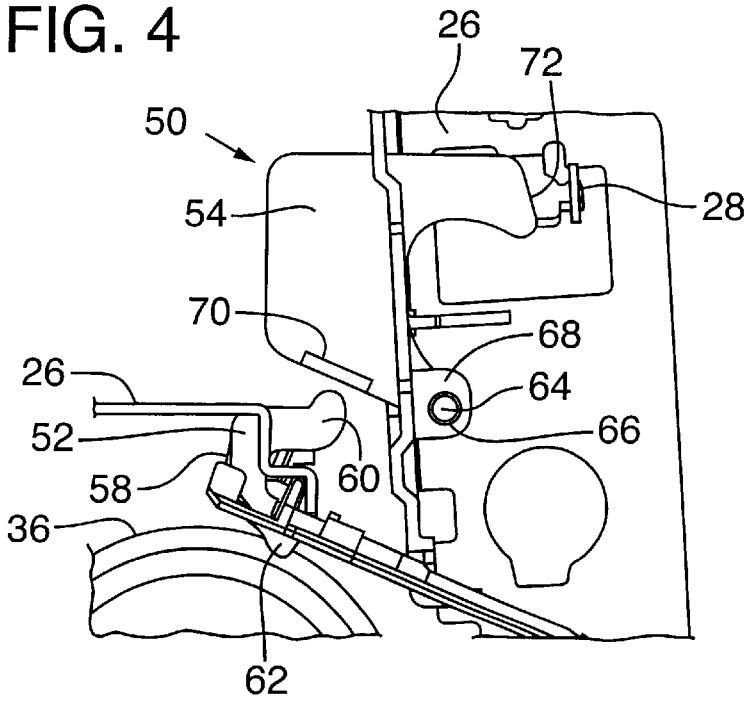
FIG. 4 is a schematic cross sectional side view illustrating the top of form sensing mechanism according to the present invention.

Similarly, an arm 64 extends laterally from each side of hammer 54 and defines the pivotal axis of the hammer. Arms 64 are mounted in openings 66 formed in tabs 68 formed in chassis 26 (FIG. 4) so that hammer 54 may pivot freely about the axis. A plate 70 is formed on the lower side of hammer 54 adjacent striker 60 on the upper end of lever 52. The opposite or forward end of hammer 54 defines an encoder strip striker 72.

In a resting or neutral position - - - that is, the position defined as when either no media is in the media drive path, or when there is media 22 advancing through the drive path but the leading edge of the media has yet to be advanced to the position of leading edge sensor assembly 50, media leading edge sensor assembly 50 is positioned as shown in FIGS. 1 through 4.

In this position, tab 62 extends into and interrupts the media drive path. This neutral position of tab 62 may be seen in FIG. 5 with respect to media 22, which in FIG. 5 is shown in dashed lines. In the neutral position, hammer 54 preferably rests on lever 52 with plate 70 touching striker 60. In this position encoder strip striker 72 rests in close proximity to but not in contact with encoder strip 28.

The sequence of steps involved in the operation of leading edge sensor assembly 50 will now be described with reference to FIGS. 5 through 8. Leading edge sensor assembly 50 is shown in the resting or neutral position in FIG. 5. As noted above, in this position tab 62 interrupts the media drive path (shown by the dashed lines of media 22). That is, the lower end of tab 62 extends inwardly beyond the outer peripheral edge of pick wheel 36 toward shaft 38. In the neutral position, plate 70 rests against striker 60.

Also, when in the neutral position, carriage assembly 20 is "parked" - - - that is, held stationary to one side of the printer as shown in FIGS. 1 and 2 such that it is located between the media leading edge sensor assembly 50 and the encoder strip tensioning spring 32, and the servo motor that drives the carriage assembly is turned off.

Figure 6:
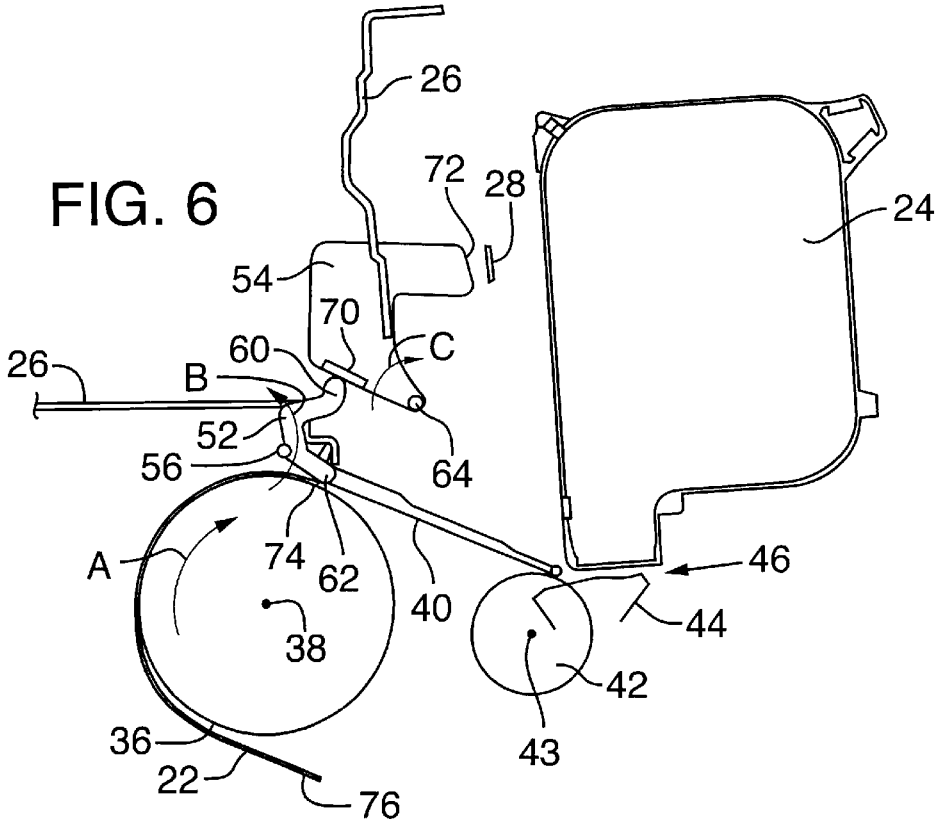
FIG. 6 is a schematic cross sectional view as in FIG. 5 showing media advancing through the printer toward and making initial contact with the top of form sensor mechanism.

Turning to FIG. 6 it may be seen that media 22 is advancing along the media drive path by rotation of pick wheel 36 in the direction of arrow A. The leading edge of the media, identified with reference number 74, as it is advanced along and follows the media drive path, makes contact with lever 52, since tab 62 is interrupting the drive path. When contact is made, leading edge 74 pushes lever 52, causing the lever to pivot about the axis defined by arms 56. As lever 52 pivots, striker 60 is driven into plate 70 of hammer 54, causing hammer 54 to pivot about the axis defined by arms 64. The rotational movement of lever 52 is illustrated with arrow B and the rotational movement of hammer 54 is shown with arrow C.

FIG. 7 illustrates the sequence of events as media 22 continues its advancement through the printer. Hammer 54 is driven by striker 60 until tab 62 is above and no longer pushed by media leading edge 74. The inertial momentum of hammer 54 as it moves in the direction of arrow C carries hammer 54 rotationally in the direction defined by arrow C until encoder strip striker 72 impacts encoder strip 28. As noted previously, encoder strip 28 extends past and in close proximity to optical sensor 29 on carriage assembly 20. The impact between striker 72 and strip 28 causes movement of the strip transversely relative to its length. This transverse motion pulls the spring-mounted end of strip 28 and optical sensor 29 detects the motion as an encoder signal change at the carriage. The carriage 20 is parked to the side of the carriage axis and the motor is off. The encoder signal change detected by the optical sensor is thus interpreted by the controller to be a zero point reference signal indicating to the printer controller that the media leading edge is now present and at a known location. A counting sequence is then begun pursuant to which the controller will begin printing at a predetermined location on media 22. Media 22 has been and continues to advance through the printer at a known, controlled rate as it passed by and under sensor assembly 50 and there may accordingly be a slight positional change in the position of the leading edge 74 between the time when the leading edge first contacts tab 62 and when the controller sees the zero point reference signal. This positional change can be accounted for in the controller.

The optical sensors 29 used with conventional encoder strips such as encoder strip 28 are highly sensitive and can detect as little motion in the strip as $1/600^{th}$ of an inch or less. The optical sensor is thus readily capable of detecting the touch of striker 72 as it touches and moves the encoder strip 28 in the manner described.

Furthermore, in the preferred embodiment it will be noted that carriage assembly 20 is parked in the neutral position at the side of the printer on which the encoder strip is connected to chassis 26 with encoder strip tensioning spring 32 (FIG. 1). There is relatively more movement of the encoder strip caused by striker 72 near the end of the strip that is sprung. Hence, when in the neutral position it is preferred that the carriage assembly is positioned - - - parked - - - between the sprung end of the strip and the position where striker 72 touches the strip.

Figure 8:
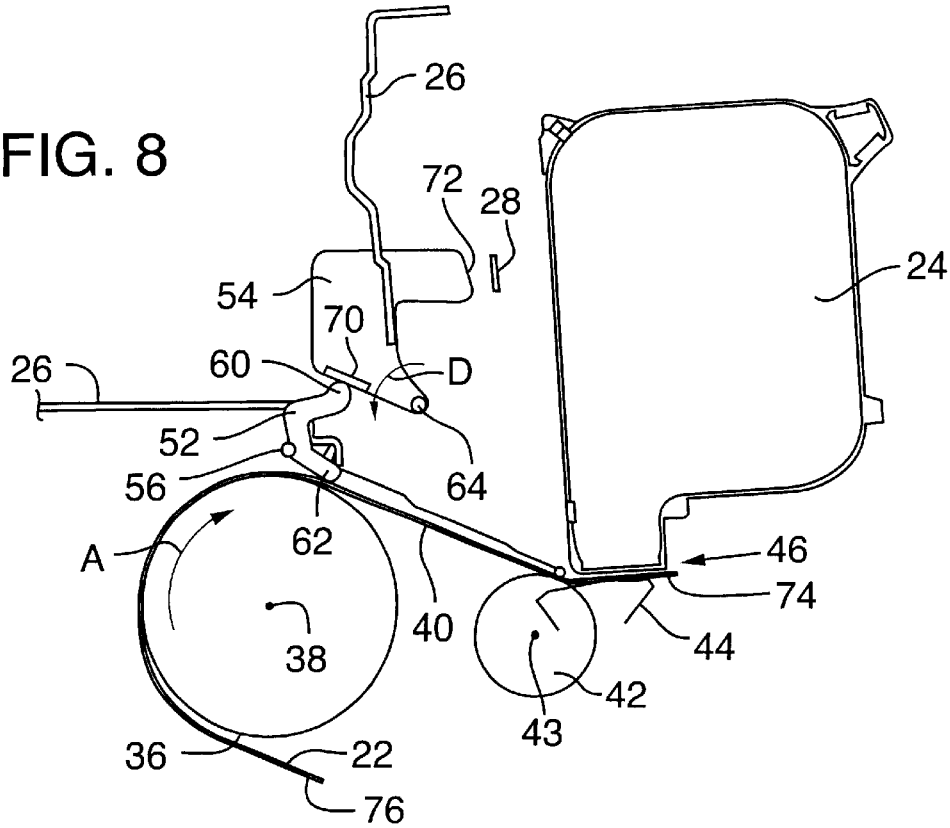
FIG. 8 is a schematic cross sectional as in FIG. 5 showing the media continuing its advancement through the printer and the hammer rebounding from the encoder strip.

Once striker 72 has touched strip 28, hammer 54 rebounds to the position shown in FIG. 8, as illustrated by arrow D. This allows for clearance between carriage 20 and sensor 29, and hammer 54 as the carriage shuttles back and forth during printing. In this position, media 22 is still present in the media drive path. Accordingly, tab 62 rides along the upper surface of the media as the media advances through the printer and in this position plate 70 rests on or near striker 60. When the trailing edge 76 of media 22 passes tab 62, lever 52 returns to the neutral position shown in FIG. 5, with tab 62 interrupting the media drive path, until the leading edge of the next media sheet renews the cycle just described.

Figure 10:
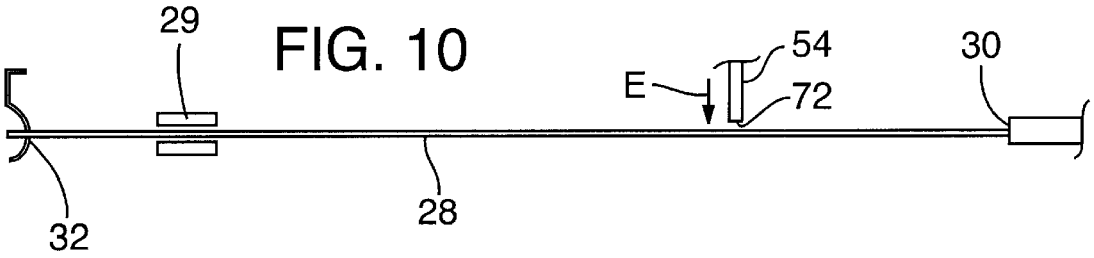
FIG. 10 is the next sequential view from FIG. 9 and shows the hammer advancing toward the encoder strip after being actuated by the advancing media leading edge.
Figure 11:
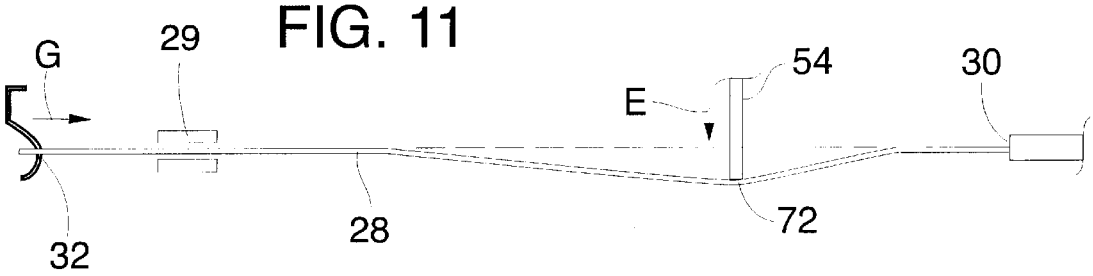
FIG. 11 is the next sequential view from FIG. 10 and shows the hammer striking and displacing the encoder strip to generate a reference signal that is detected by an optical sensor.

The sequence of events described above leading to the generation of the zero point reference signal are illustrated in the highly schematic sequential images in FIGS. 9 through 12. The leading edge sensor assembly is shown in the neutral position in FIG. 9, with optical sensor 29 (which is attached to carriage 20 - - - not shown) parked between hammer 54 and encoder strip tensioning spring 32. FIG. 10 illustrates the movement of hammer 54 when the media leading edge has just advanced into tab 62. Thus, hammer 54 is driven toward strip 28 in the direction of arrow E. Striker 72 has touched strip 28 in FIG. 11 and displaces strip 28 (the amount of displacement is shown exaggerated by the dashed lines representing the neutral position of strip 28), which pulls strip tensioning spring 32 inwardly as indicated by arrow G. Optical sensor 29 detects the movement of strip and the zero point reference signal is thus generated.

Figure 12:
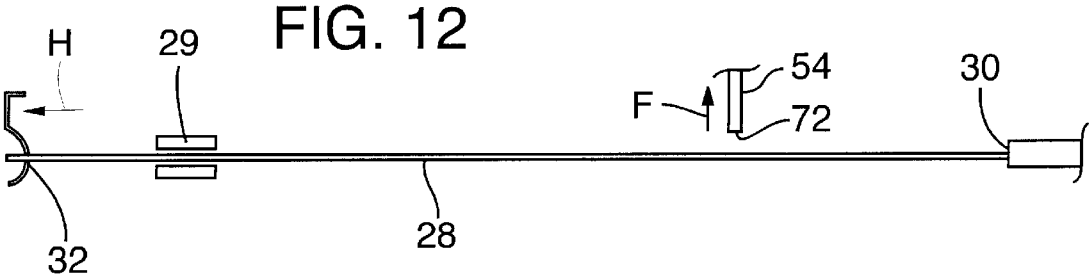
FIG. 12 is the next sequential view from FIG. 11 and shows the hammer rebounding after it has struck the encoder strip.

Finally, in FIG. 12 the hammer 54 is rebounding in the direction of arrow F from its contact with the encoder strip by the reverse pulling action of strip tensioning spring 32, as indicated by arrow H. The hammer will rebound into the position described above with reference to FIG. 8 to permit clearance between the carriage and optical sensor, and the hammer.

As described above, the present invention detects the leading edge of an advancing print media, and once the leading edge is detected, a reference signal is generated and transmitted to the printer controller. The reference signal is generated with hardware already used in the printer - - - the carriage axis encoder strip and sensor. In addition to the specific lever and hammer structure described above for detecting the presence of the media leading edge and striking the encoder strip, there are numerous other linkages that may be used to detect the leading edge of the media and cause a signal to be generated with the carriage encoder. Stated another way, the present invention uses the leading edge of media advancing through the printer cause a mechanism to strike the strip encoder, thereby generating a signal that the printer controller interprets as the presence of the media leading edge.

In addition, by inclusion of a small spring to forcibly return lever 52 to its neutral position, and a small cam surface or selective positioning of striker 60, enough motion could be imparted to hammer 54 to enable detection of the trailing edge 76 of the media. Finally, for printers capable of duplexing operations in which media is moved "backwardly" through the media path, detection of the backwardly moving media may be enabled through use of a "secondary flag" that interrupts the media drive path in the manner described above.

Although preferred and alternative embodiments of the present invention have been described, it will be appreciated by one of ordinary skill in this art that the spirit and scope of the invention is not limited to those embodiments, but extend to the various modifications and equivalents as defined in the appended claims.

What is claimed is:

1. A method of detecting the leading edge of a sheet of print media as the print media is advanced along a media drive path through a printer having a carriage axis strip encoder, the method comprising the steps of:

(a) interrupting the media drive path when there is no print media in the media drive path with a leading edge detecting member that has a striker positioned adjacent the strip encoder when there is no print media in the media drive path;

(b) advancing the print media along the media drive path and into the leading edge detecting member; and (c) causing the striker of the leading edge detecting member to strike the strip encoder.

2. The method of claim 1 including the step of generating a zero point reference signal when the leading edge detecting member strikes the strip encoder.

3. The method of claim 2 including the step of correlating the reference signal to the position on the media where printing begins.

4. The method of claim 1 wherein in step (c) the leading edge detecting member is moved by the leading edge of the advancing print media and the movement of the advancing print media causes the striker of the leading edge detecting member to strike the strip encoder.

5. The method of claim 4 including the step of driving the leading edge detecting member into a hammer that strikes the strip encoder.

6. The method of claim 5 wherein striking the strip encoder causes the strip encoder to move, and including the step of detecting the movement of the strip encoder with an optical sensor carried on a print cartridge carriage.

7. The method of claim 5 including the step of generating a zero point reference signal when the hammer strikes the strip encoder.

8. The method of claim 7 including the step of correlating the zero point reference signal to a location on the print media where ink begins to be deposited.

9. Apparatus for detecting the leading edge of print media in a printer, comprising:

at least one print media advancement wheel configured for advancing the print media through the printer along a print media drive path;

an encoder strip; and a leading edge detecting linkage member having a first end interrupting the drive path and a second end positioned adjacent the encoder strip to strike the encoder strip when the leading edge of print media is advanced into the leading edge detecting linkage member.

10. The apparatus of claim 9 wherein the print media advancement wheel comprises plural friction wheels and the media drive path follows the outer peripheral edges of the wheels, and wherein the first end of the media leading edge detecting linkage member extends into the media drive path.

11. The apparatus of claim 9 wherein the leading edge detecting linkage member further comprises a lever having a first end which in a neutral position interrupts the media drive path and a second end, the lever pivotal about an axis between the first and second ends transverse to the axis defined by the media drive path, the second end of the lever positioned adjacent an encoder hammer.

12. The apparatus of claim 11 wherein the hammer has a first end adjacent the second end of the lever and a second end adjacent the encoder strip, the hammer being pivotal about an axis transverse to the media drive path axis.

13. The apparatus of claim 12 wherein movement of the lever from the neutral position to a second position causes the second end of the hammer to strike the encoder strip.

14. The apparatus of claim 9 wherein when no print media is in the media drive path the leading edge detecting linkage member is in a first position and advancing the leading edge of print media into the leading edge detecting linkage member moves the leading edge detecting linkage member into a second position in which the encoder strip is stricken.

15. In a printer having a carriage axis strip encoder for detecting the position of a print carriage, a top of form detector comprising:

print media advancement means for advancing media through the printer, the print media defining a print media path as it advances through the printer;

top of form detection means interrupting the print media path and configured for touching the strip encoder when print media is advanced along the print media path into contact with the detection means.

16. The top of form detector of claim 15 wherein the top of form detecting means further comprises:

a lever having a first end extending into the print media path and a second end, the lever pivotal between a first neutral position wherein the first end extends into the print media path and a second position;

a hammer adjacent the second end of the lever such that the lever contacts the hammer when the lever is in the second position, the hammer comprising a strip encoder striker for touching the strip encoder when the lever is in the second position.

17. The top of form detector of claim 15 including a sensor for detecting movement of the strip encoder when struck by the hammer.

18. The top of form detector of claim 17 wherein a reference signal is generated when the strip encoder is struck by the hammer and the reference signal correlates to a position on the media where printing begins.

19. A method of detecting edge of a sheet of print media as the print media is advanced along a media drive path through a printer of the type having a strip encoder for controlling the position of a print cartridge, the method comprising the step of:

(a) detecting the presence of the media leading edge by interposing in the media drive path a leading edge detector that has a striker positioned adjacent to the strip encoder;

(b) advancing the media along the media drive path and into the leading edge detector; and (c) in response to step (b), causing the striker to contact the strip encoder to generate a reference signal corresponding to the presence of the media leading edge.

20. The method of claim 19 wherein the step of generating the reference signal includes striking the strip encoder in response to the presence of the media leading edge.

* * * * *